United States Patent [19]

Chang

[11] 4,178,228

[45] Dec. 11, 1979

[54] THERMAL CRACKING OF GAS OIL TO MIDDLE DISTILLATE

[75] Inventor: Bong H. Chang, Baton Rouge, La.

[73] Assignee: Exxon Research & Engineering Co., Florham Park, N.J.

[21] Appl. No.: 913,307

[22] Filed: Jun. 7, 1978

[51] Int. Cl.[2] ..... C10G 9/46; C10G 37/02

[52] U.S. Cl. ..... 208/72; 208/67; 208/77; 208/102; 208/106

[58] Field of Search ..... 208/67, 106, 72, 77

[56] References Cited

U.S. PATENT DOCUMENTS

| | | | |
|---|---|---|---|
| 2,249,705 | 7/1941 | Eastman et al. | 208/77 X |
| 2,378,067 | 6/1945 | Dorsett et al. | 260/668 R |
| 3,707,459 | 12/1972 | Mason et al. | 208/76 |
| 3,954,599 | 5/1976 | Ooka | 208/89 |

FOREIGN PATENT DOCUMENTS

| | | | |
|---|---|---|---|
| 282794 | 1/1964 | Netherlands | 208/106 |
| 722369 | 1/1955 | United Kingdom | 208/106 |

OTHER PUBLICATIONS

Chemical Abstracts 49, 8593a (1955) for Brit. 722,369.
Chemical Abstracts 61, 15910e (1964) for Neth. 282,794.

*Primary Examiner*—Delbert E. Gantz
*Assistant Examiner*—G. E. Schmitkons
*Attorney, Agent, or Firm*—Marthe L. Gibbons

[57] ABSTRACT

A mild thermal cracking of gas oil in the presence of added olefinic naphtha increases the yield of middle distillate.

17 Claims, 2 Drawing Figures

THERMAL CRACKING OF GAS OIL TO MIDDLE DISTILLATE

BACKGROUND OF THE INVENTION

1. Field of the Invention

This invention relates to thermal cracking of a gas oil. It particularly relates to a mild thermal cracking of gas oil to minimize the production of naphtha and increase the amount of middle distillate components.

2. Description of the Prior Art

Mild thermal cracking processes are well known in the art. Heavy hydrocarbonaceous oils are subjected to mild thermal cracking processes to convert at least a portion of the high boiling components to lower boiling components. The naphtha component which is obtained from thermal cracking processes is usually of poor quality, that is, it has a high content of olefins and sulfur which makes it undesirable for many end uses. Improvements in thermal cracking have been proposed to minimize the amount of naphtha product, that is, to increase the amount of middle distillate components relative to the amount of naphtha component obtained from the process. For example, Netherland patent application No. 282,794 discloses a mild thermal cracking process (visbreaking) of heavy hydrocarbon oils containing residual fractions in which the process is conducted in the presence of added naphtha, such as a recycle naphtha stream from the visbreaking process, to decrease the net naphtha yield and to increase the middle distillate component. The term "net yield" relative to naphtha refers to the total naphtha yield less the quantity of added naphtha.

It is also known to recycle countercurrently the overhead products including and up to light gas oil to a visbreaking stage of heavy hydrocarbon oils, such as reduced crude. The recycled overhead products provide the endothermic heat of conversion of the heavy oil and the heat of vaporization of the distillate material (see, for example, British Pat. No. 722,369).

A vapor phase type cracking of heavy oil, which may be a gas oil, is known in which an aromatic product is recycled. The final product includes an increased amount of butadiene and ethylene (see U.S. Pat. No. 2,378,067).

A one or two-step process is known for the thermal treatment of heavy hydrocarbons boiling mostly above 1000° F. The process includes a recycle step wherein a portion of low boiling material, which may have a boiling range below 650° F., and all of the heavy material including unconverted feed, is recycled to the thermal cracking step (see U.S. Pat. No. 3,707,459).

A catalytic cracking process is known in which a gas oil is cracked in the presence of the catalyst and added naphtha to obtain an increased yield of middle distillate (see U.S. Pat. No. 3,954,600).

It has now been found that thermal cracking of a feedstock consisting essentially of gas oil in the absence of a catalyst and in the presence of added naphtha only will minimize the net yield of naphtha in the thermally cracked product.

SUMMARY OF THE INVENTION

In accordance with the invention there is provided, a process for the thermal cracking of a hydrocarbonaceous oil feed which comprises: (a) treating a hydrocarbonaceous oil feed consisting essentially of gas oil in a thermal cracking zone at thermal cracking conditions in the absence of a catalyst and in the presence of an added olefin-containing naphtha and (b) recovering a thermally cracked product.

In one embodiment of the invention, the gas oil thermal cracking stage is the second thermal cracking stage of an integrated process in which a heavier hydrocarbonaceous oil is first thermally cracked and the gas oil product resulting from the first thermal cracking stage is used as at least a portion of the feed of the second thermal cracking stage.

DESCRIPTION OF THE PREFERRED EMBODIMENTS

The preferred embodiments of the invention will be described with reference to the accompanying drawings.

Figure 1:
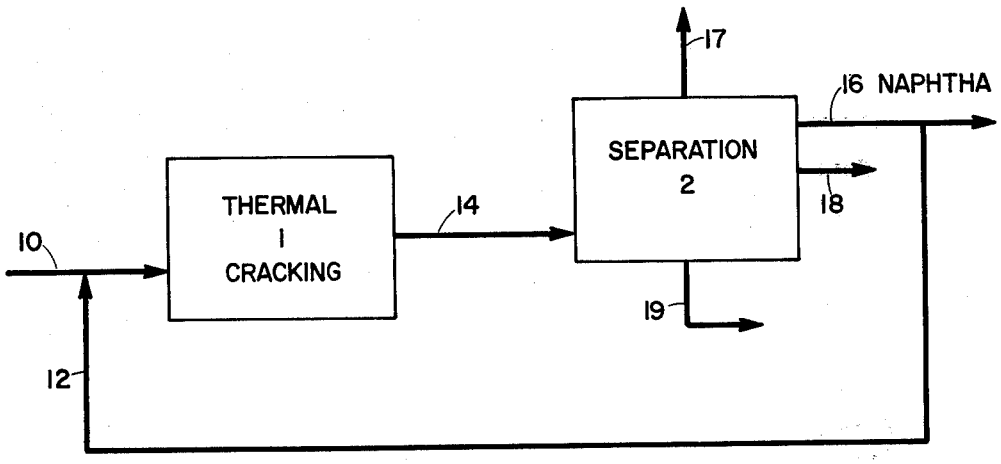
FIG. 1 is a schematic flow plan of one embodiment of the invention.

Referring to FIG. 1, a hydrocarbonaceous oil feed consisting essentially of gas oil is introduced into a thermal cracking zone 1. By the term "gas oil" is intended herein a mixture of hydrocarbons boiling, at atmospheric pressure, in the range of about 430° to 1100° F. It may be preferred to utilize a gas oil boiling in the range of 600° to 1050° F. A stream of olefin-containing naphtha is introduced via line 12 into line 10 which carries the gas oil feed into the thermal cracking zone. Typically, the thermal cracking zone will comprise coils disposed in a furnace. Alternatively, the olefin-containing naphtha could be introduced separately into the thermal cracking zone. Suitable olefin-containing naphthas are mixtures of hydrocarbons boiling at atmospheric pressure in the range of about C5 to 430° F., which contain at least about 10 volume percent olefins boiling within the naphtha range. Preferably, the olefin-containing naphtha is a fraction that contains less than 30 volume percent aromatics, more preferably less than 20 volume percent aromatics.

Suitable olefin-containing naphthas include, for example, naphtha produced by mild thermal cracking processes; naphtha produced by a catalytic cracking process (cracked naphtha); naphtha produced by a coking process (coker naphtha); naphtha produced by a steam cracking process (steamed cracked naphtha). Preferably, a recycled stream of naphtha produced from the mild thermal cracking process is utilized. If desired, the aromatics may be extracted by conventional means from the olefin-containing naphtha stream prior to adding the naphtha to the thermal cracking process since the presence of aromatics is not essential to the process and that aromatics may find more valuable uses in other processes.

The volumetric ratio of naphtha to gas oil in the mixture introduced into the thermal cracking zone may range broadly from about 0.01:1 to 0.5:1, preferably from about 0.05:1 to 0.25:1.

The gas oil and added olefin-containing naphtha are subjected to thermal cracking conditions in thermal cracking zone 1. Suitable thermal cracking conditions include a temperature ranging from about 700° to 1100° F., preferably a temperature ranging from about 800° to about 950° F. and a pressure ranging from about 50 to about 1500 psig, preferably a pressure ranging from about 200 to 1200 psig. The thermal cracking zone may be a coil disposed in a heated furnace.

Under the above conditions, the gas oil is partially converted to lower boiling hydrocarbon products. The thermally cracked products are removed from the thermal cracking zone 1 by line 14 and passed to a separation zone 2. Separation of the thermally cracked products is carried out in a conventional manner such as by fractional distillation. An olefin-containing naphtha fraction is recovered via line 16 and gas is recovered by line 17. Middle distillates are recovered by line 18. A heavy fraction is removed by line 19.

In the preferred embodiments shown in FIG. 1, at least a portion of the olefin-containing naphtha produced from the thermal cracking stage is recycled via line 12 for introduction into thermal cracking zone 1 as the added olefin-containing naphtha.

Figure 2:
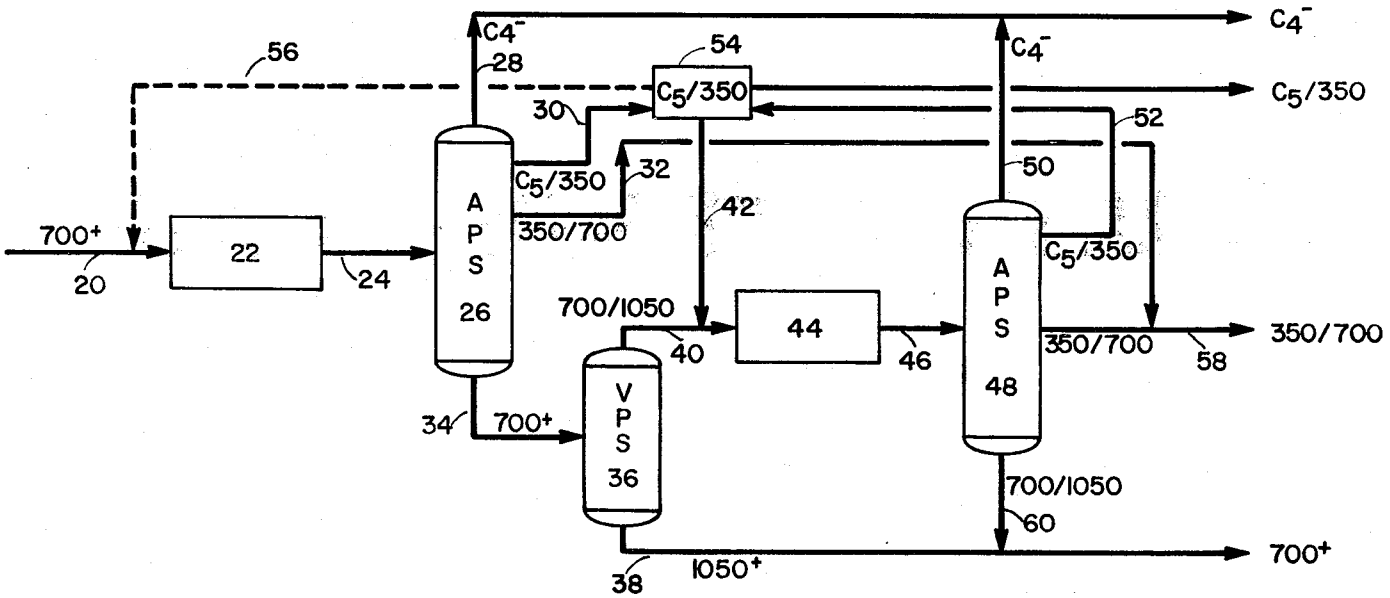
FIG. 2 is a schematic flow plan of another embodiment of the invention.

Referring to FIG. 2, which shows a two-stage thermal cracking process, a heavy hydrocarbonaceous oil comprising residual components, such as a heavy crude petroleum oil is passed by line 20 into a first thermal cracking stage 22. Suitable conditions for the first thermal cracking stage include a temperature ranging from about 700° to about 1100° F., preferably from about 750° to about 950° F., and a pressure ranging from about 50 to about 1500 psig, preferably from about 200 to about 1200 psig. When the desired degree of conversion has been obtained, the thermally cracked product resulting from the first thermal cracking zone is passed by line 24 to a separation zone 26, which may be an atmospheric pipestill, wherein the cracked products are separated into a C4− gas recovered by line 28, a C5 to 350° F. naphtha fraction removed by line 30, a 350° to 700° F. fraction removed by line 32 and a 700° F.+ fraction removed by line 34. The 700° F.+ fraction is passed to separation zone 36 such as a vacuum pipestill. The vacuum residuum boiling above 1050° F. is removed via line 38. The gas oil fraction boiling in the range of 700° to 1050° F. (at atmospheric pressure) is removed via line 40 and passed to a second thermal cracking zone, that is, to zone 44 by line 40. A portion of the olefin-containing naphtha, internally generated by the process, is introduced into line 40 by line 42. The thermal cracking zone 44 into which only gas oil and added olefin-containing naphtha are subjected to thermal cracking may be operated at relatively more severe thermal cracking conditions than the actual thermal cracking conditions used in a first thermal cracking zone (22). Suitable thermal cracking conditions for zone 44 include a temperature ranging from about 700° to about 1100° F., preferably from about 800° to about 950° F. and a pressure ranging from about 50 to about 1500 psig, preferably from about 200 to about 1200 psig. The thermally cracked effluent of zone 44 is removed via line 46 and passed to a separation zone 48 such as an atmospheric pipestill. A gas stream is removed via line 50. An olefin-containing naphtha stream is removed via line 52 and passed to a mixing zone 54 wherein it is mixed with a naphtha of line 30 for use as recycle to the thermal cracking zones. If desired, a portion of the olefin-containing naphtha produced in the process may also be recycled to the first thermal cracking zone 22 via line 56. A 350° to 700° F. fraction is recovered from zone 48 via line 58 and a 700° to 1050° F. fraction is recovered via line 60. The cut points of the various fractions given in the description of the FIG. 2 embodiment are merely exemplary and given for simplicity of description. The given cut points are not critical for the operation of the process and may be varied as would be evident to one skilled in the art. All boiling points referred to herein are atmospheric pressure boiling points unless otherwise specified.

The following example is presented to illustrate the invention.

EXAMPLE

Thermal cracking experiments were conducted with and without the addition of naphtha. The conversion level was held constant at about 29 weight percent conversion to 700 minus products based on feed. The gas oil utilized as feed in these experiments was a 700° to 1050° F. gas oil. In the run in which naphtha was used, the naphtha employed comprised 36.2 volume percent olefins and 9.5 volume percent aromatics. The operating conditions and results of these experiments are summarized in the following table.

TABLE

| Run | 1 | 2 |
|---|---|---|
| Gas Oil, wt. % on mixture | 100 | 84.7 |
| Naphtha, wt. % on mixture | — | 15.3 |
| Operating Conditions | | |
| Temperature, °F. | 848 | 852 |
| Pressure, psig | 895 | 928 |
| Space velocity of gas oil, V/Hr/V at 60° F. | 4.69 | 1.48 |
| Product Yields on Mixture, wt. % | | |
| $C_4^-$ | 2.5 | 3.9 |
| $C_5$–350° F. | 6.5 | 13.5 |
| 350–700° F. | 20.0 | 21.9 |
| 700° F.+ | 71.0 | 60.7 |
| Net Yield on Gas Oil Only, wt. %(1) | | |
| $C_4^-$ | 2.5 | 4.6 |
| $C_5$–350° F. | 6.5 | −2.2 |
| 350–700° F. | 20.0 | 25.9 |
| 700° F.+ | 71.0 | 71.7 |
| Conversion of Gas Oil to 700° F.−, wt. % | 29.0 | 28.3 |

(1)Calculated by substracting the amount of naphtha added from total naphtha product and then normalizing the yields to 100 percent.

As can be seen from the table, run 2, which is a run in accordance with the present invention, gave essentially no net naphtha yield, whereas run 1, which is a run in which no naphtha was added to the gas oil feed, gave a significant amount of net naphtha product.

What is claimed is:

1. A process for the thermal cracking of a hydrocarbonaceous oil feed, which comprises:

(a) treating a hydrocarbonaceous oil consisting essentially of gas oil in a thermal cracking zone at thermal cracking conditions in the absence of a catalyst, in the absence of added oxygen, and in the presence of an added olefin-containing naphtha, said naphtha containing at least about 10 volume % olefins and less than about 30 volume % aromatics, and (b) recovering the thermally cracked products.

2. The process of claim 1 wherein said thermal cracking conditions include a temperature ranging from about 700° to about 1100° F.

3. The process of claim 1 wherein said thermal cracking conditions include a temperature ranging from about 800° to about 950° F.

4. The process of claim 1 wherein said thermal cracking conditions include a pressure ranging from about 50 to 1500 psig.

5. The process of claim 1 wherein said thermal cracking conditions include a pressure ranging from about 200 to about 1200 psig.

6. The process of claim 1 wherein said olefin-containing naphtha is separated from said thermally cracked product and wherein at least a portion of the separated olefin-containing naphtha is recycled to said thermal cracking zone.

7. The process of claim 1 wherein said olefin-containing naphtha is produced by a thermal cracking process.

8. The process of claim 1 wherein said feed of step (a) is obtained by treating a heavy hydrocarbonaceous oil in a thermal cracking zone at thermal cracking conditions to produce a thermally cracked product, separating a gas oil fraction from said thermally cracked product and subjecting at least a portion of the separated gas oil to said thermal cracking zone of step (a).

9. The process of claim 8 wherein the thermal cracking conditions of said heavy hydrocarbonaceous oil treating zone include a temperature ranging from about 700° to about 1100° F. and wherein said thermal cracking conditions of said gas oil treating zone include a temperature ranging from about 700° to about 1100° F.

10. The process of claim 9 wherein said olefin-containing naphtha is also added to said thermal cracking zone of said heavy hydrocarbonaceous oil.

11. The process of claim 1 wherein the volumetric ratio of said added naphtha to said gas oil ranges from about 0.1:1 to 0.5:1.

12. The process of claim 1 wherein said olefin-containing naphtha comprises less than 20 volume percent aromatics.

13. The process of claim 1 wherein said olefin-containing naphtha is essentially free of aromatics.

14. A process for the thermal cracking of a hydrocarbonaceous feedstock which comprises: contacting a hydrocarbonaceous feedstock consisting essentially of a gas oil at mild thermal cracking conditions including a temperature ranging from about 800° to 950° F., a pressure ranging from about 200 to about 1200 psig in the absence of a catalyst, in the absence of added oxygen, and in the presence of an added olefin-containing naphtha, said naphtha containing at least about 10 volume % olefins and less than about 30 volume % aromatics.

15. A two-stage process for the thermal cracking of a hydrocarbonaceous feedstock which comprises:

(a) treating a heavy hydrocarbonaceous oil comprising residual components in a first thermal cracking zone at thermal cracking conditions including a temperature ranging from about 700° to 1100° F. and a pressure ranging from about 50 to about 1500 psig to produce a first thermally cracked product;

(b) separating from said first thermally cracked product a gas oil fraction;

(c) passing at least a portion of said separated gas oil fraction to a second thermal cracking zone;

(d) treating said portion of said separated gas oil in said second thermal cracking zone at thermal cracking conditions including a temperature ranging from about 700° to 1100° F. and a pressure ranging from about 50 to about 1500 psig in the presence of an added olefin-containing naphtha, said naphtha containing at least about 10 volume % olefins and less than about 30 volume % aromatics.

16. The process of claim 15 wherein said first thermal cracking zone in operated at a temperature ranging from about 750° to about 950° F. and wherein said second thermal cracking zone is operated at a temperature ranging from about 800° to about 950° F.

17. The process of claim 15 wherein said first thermal cracking zone also comprises an added olefin-containing naphtha.

* * * * *